US005613349A

United States Patent [19]

Brown

[11] Patent Number: 5,613,349

[45] Date of Patent: Mar. 25, 1997

[54] METHOD OF MAKING PRODUCT PACKAGES

[75] Inventor: Gerald L. Brown, Charlotte, N.C.

[73] Assignee: ELR, Inc., Charlotte, N.C.

[21] Appl. No.: 519,994

[22] Filed: Aug. 28, 1995

[51] Int. Cl.[6] ..... B65B 47/00

[52] U.S. Cl. ..... 53/453; 53/411; 53/474; 53/478

[58] Field of Search ..... 53/474, 477, 453, 53/411, 475; 206/461, 469, 470, 831

[56] References Cited

U.S. PATENT DOCUMENTS

| | | | |
|---|---|---|---|
| 2,993,590 | 7/1961 | Denton . | |
| 3,279,596 | 10/1966 | Hans-August Prym et al. . | |
| 3,289,830 | 12/1966 | Foote . | |
| 3,395,792 | 8/1968 | Larson | 206/831 |
| 3,476,239 | 11/1969 | Jacob | 53/411 |
| 3,638,784 | 2/1972 | Bodolay et al. | 383/38 |
| 3,737,029 | 6/1973 | Serrell et al. . | |
| 4,062,449 | 12/1977 | Popkes et al. | 53/411 |
| 4,125,190 | 11/1978 | Davie, Jr. et al. . | |
| 4,200,193 | 4/1980 | Boyle . | |
| 4,311,234 | 1/1982 | Wildgoose . | |
| 4,803,048 | 2/1989 | Nason . | |
| 5,098,131 | 3/1992 | Tucker . | |
| 5,203,455 | 4/1993 | Hewelt et al. | 53/453 |
| 5,353,935 | 10/1994 | Yeager et al. | 206/470 |

FOREIGN PATENT DOCUMENTS

| | | |
|---|---|---|
| 2410611 | 6/1979 | France . |
| 2233822 | 1/1974 | Germany . |
| 3612065 | 10/1987 | Germany . |
| 911345 | 11/1962 | United Kingdom . |

OTHER PUBLICATIONS

J. Butschli, *Trapped coupons free Maybelline sales,* Jan., 1995, Packaging World.

*Primary Examiner*—John Sipos
*Assistant Examiner*—Ed Tolan
*Attorney, Agent, or Firm*—Bell, Seltzer, Park & Gibson, P.A.

[57] ABSTRACT

A process of manufacturing product packages having a multilayer backing member, a plastic product enclosure adhered to a front layer of the backing member, and a removable panel in a back layer for enclosing ancillary materials. The process includes the steps of printing a plurality of backing member patterns on a sheet of backing member material, applying a heat-resistant coating to back layer portions of the backing members, applying a heat-seal coating to front layer portions of the backing members, cutting the sheet to define individual backing members and the removable panel, and applying adhesive to and folding together the front and back layer portions with the ancillary materials therebetween so as to form individual backing members. A plastic product enclosure and the product may then be heat-sealed to the backing member.

20 Claims, 4 Drawing Sheets

12
13
24
25
26
27
30
31
32
16
11A

METHOD OF MAKING PRODUCT PACKAGES

BACKGROUND OF THE INVENTION

Packages for consumer products known as "blister cards" often include a backing member made of cardboard or other rigid material and a clear plastic product enclosure adhered to one side of the backing member. The clear plastic enclosure, which is commonly referred to as a "blister", is typically thermoformed to conform in size and shape to that of the product being packaged. The enclosure thus securely holds the product in the package and allows the consumer to clearly see the product when making a purchasing decision. The backing member may have information regarding the product, such as promotional or instructional material, printed on one or both sides thereof.

These blister cards may take several forms. For example, U.S. Pat. No. 3,289,830 to Foote entitled Display Card Mounted Retainer and Packaging Device discloses a single or multilayered display card having a thermoformed transparent flexible plastic retainer which is affixed against the front face of the card. Perforations on the back face of the card define flaps and allow the package to be opened and the product thereafter removed through the opening. An instructional ticket may be inserted between the product and the card so that the ticket will be removed prior to removing the product from the package.

Another example is U.S. Pat. No. 4,125,190 to Davie, et al. entitled Child-Resistant Blister Package. Disclosed therein is a foil-backed blister sheet sandwiched between upper and lower card sheets which are heat-sealed together. A third card having a tear strip is heat-sealed against the lower card sheet.

A desirable blister card which may be manufactured according to the process of the present invention includes a backing member made of multiple layers of paperboard. The backing member may have a removable panel in a back layer of the backing member such that when the panel is removed, various ancillary materials are exposed, such as coupons, detailed instructions or security devices. In addition, a clear plastic product enclosure may be adhered to a front layer of the backing member.

In manufacturing the product enclosure, it is often desirable to provide a flange around the peripheral edge thereof so that the enclosure can be heat-sealed to the front layer of the backing member. In addition, it is generally advantageous to use a heat-seal coating between the flange of the enclosure and the backing member to promote adhesion.

When heat-sealing the product enclosure to the backing member, a heated heat-seal head is placed against the back side of the backing member opposite the product enclosure. The heat-seal head corresponds in size and shape to the flange of the product enclosure and cooperates with an unheated supporting member on the front side of the backing member, which may also have a size and shape corresponding to that of the heat-seal head. Accordingly, as the heat-seal head and supporting member are pressed together, heat travels from the head through the backing member so that the flange of the product enclosure is adhered to the front side of the backing member.

Because of the multiple layers and ancillary materials of the backing member manufactured according to the present invention, a generally higher temperature for the heat-seal head is required. In addition, a longer dwell duration for which the heat-seal head must be placed against the backing member may also be required. As a result of the greater heat transfer, however, it is possible for the back layer of the backing member to-become scorched or burned. This is an even greater concern when "coated" paperboard is used, i.e., paperboard which has been treated to have a smooth, glossy finish.

Accordingly, it is an object of the present invention to provide an improved process of manufacturing product packages of this type.

It is another object of the present invention to provide a process for manufacturing product packages having multilayer backing members and a plastic enclosure heat-sealed to a front layer thereof.

It is yet another object of the present invention to provide a process for manufacturing product packages having a multilayer backing member wherein a plastic enclosure is heat-sealed to the backing member without scorching or burning the backing member.

SUMMARY OF THE INVENTION

The present invention is a process of manufacturing product packages having a multilayer backing member, a plastic product enclosure adhered to a front layer of the backing member and a removable panel in a back layer thereof for enclosing ancillary materials. The manufacturing process according to the present invention includes the step of printing on one surface of a blank sheet of backing member material, such as paperboard, a plurality of decorative patterns to be displayed on individual packages. The patterns are arranged so as to define a plurality of backing members each having at least a front layer portion and a back layer portion. One or more intermediate layers may also be included. The patterns may be applied to the paperboard by way of a lithographic printing process.

A heat-resistant coating may then be applied to the back layer portions of the backing members by way of a lithographic printing process so as to prevent scorching or burning when the heat-seal head is applied thereto. A heat-seal coating may also be applied to the front layer portions of the backing members so as to promote adhesion between the plastic product enclosure and the front layer portions when a heat-seal head is applied. The heat-seal coating may be pattern-applied by way of a relief printing process.

The sheet may then be cut along the decorative pattern boundaries to form a plurality of backing member blanks and further to form a pattern of perforations in the back layer portions of each of the blanks, thereby defining a removable panel in each of the blanks. Ancillary materials, such as a coupon booklet, may be placed against the unprinted surface of the removable panel of each individual blank and adhesive is applied to the unprinted surface of at least one layer of the blank. The front and back layers and any intermediate layers are then folded against each other, thereby forming the multilayer backing member.

The product enclosure, having the product held therein, is then placed in contact with the front layer of the backing member and heat is applied to the back layer so as to heat-seal the product enclosure to the backing member. The heat-resistant coating applied to the back layer prevents the heat-seal head from scorching the paperboard.

BRIEF DESCRIPTION OF THE DRAWINGS

Some of the objects and advantages of the present invention having been stated, others will appear as the description proceeds when taken in conjunction with accompanying drawings in which.

DETAILED DESCRIPTION OF PREFERRED EMBODIMENTS

The present invention now will be described more fully hereinafter with reference to the accompanying drawings, in which preferred embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those of skill in the art. Like numbers refer to like elements throughout.

The present invention is directed to manufacturing the product package 10 illustrated in FIGS. 1–4, which is described prior to describing the process. The product package 10, which is commonly referred to in the industry as a "blister card", includes a multilayer backing member 11 formed of a substantially rigid material such as cardboard or paperboard. One particular type of product package which may be manufactured according to the present invention is discussed in "Trapped Coupons Free Maybelline Sales", *Packaging World*, January, 1995, which is incorporated by reference herein.

Figure 3:
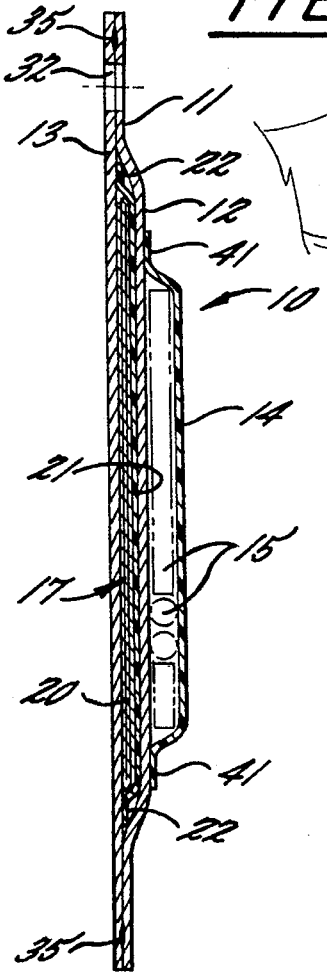
FIG. 3 is a sectional view of the product package shown in FIGS. 1 and 2 as taken along lines of 3—3 of FIG. 1.

One or both sides of each layer of paperboard may have been "coated" meaning that the typically rough and absorbent surface of the paperboard was chemically and/or mechanically treated to provide a smooth, hard and glossy finish. One preferred type of paperboard is 14-pt SBS from Federal Paper Board. As shown in FIG. 3, one preferred embodiment of the backing member 11 has two layers including a front layer 12 and a back layer 13, although one or more intermediate layers may also be included therebetween, as discussed below.

Adhered to the front layer 12 of the backing member 11 is a product enclosure 14, commonly referred to as a "blister" or "blister pack" for retaining a product 15 against the backing member. The product enclosure 14 may be formed of a transparent material to allow the product 15 to be viewed by the consumer. In addition, the enclosure 14 may be formed of a thermoplastic material so that it can be thermoformed to correspond in size and shape to the particular product 15 being packaged and ensure a snug fit. One preferred material for the product enclosure is clear PVC.

Figure 1:
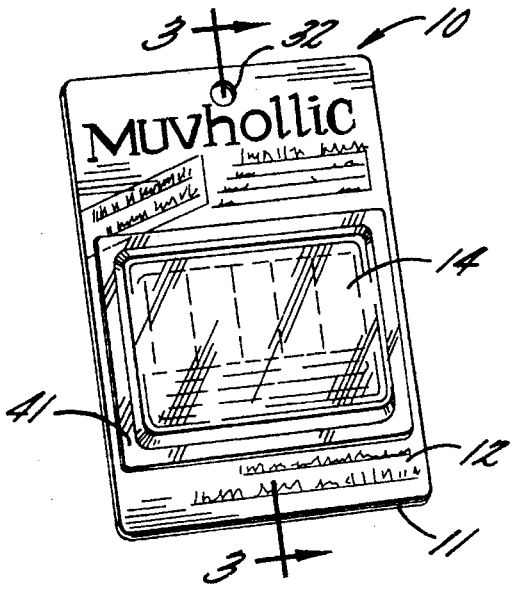
FIG. 1 is a perspective view of the front side of a product package which may be manufactured according to the present invention.
Figure 2:
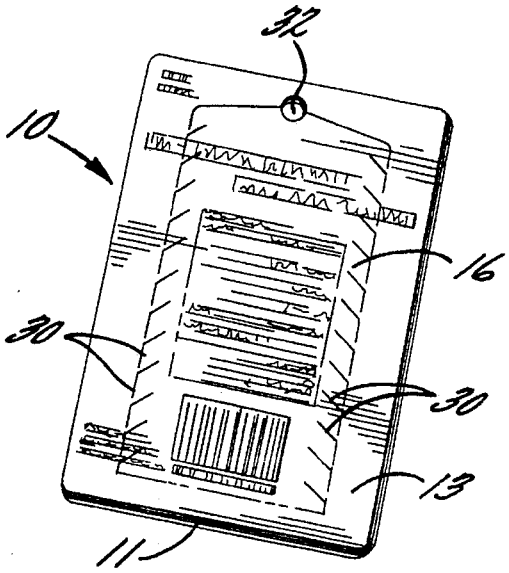
FIG. 2 is a perspective view of the rear side of the package shown in FIG. 1.
Figure 4:
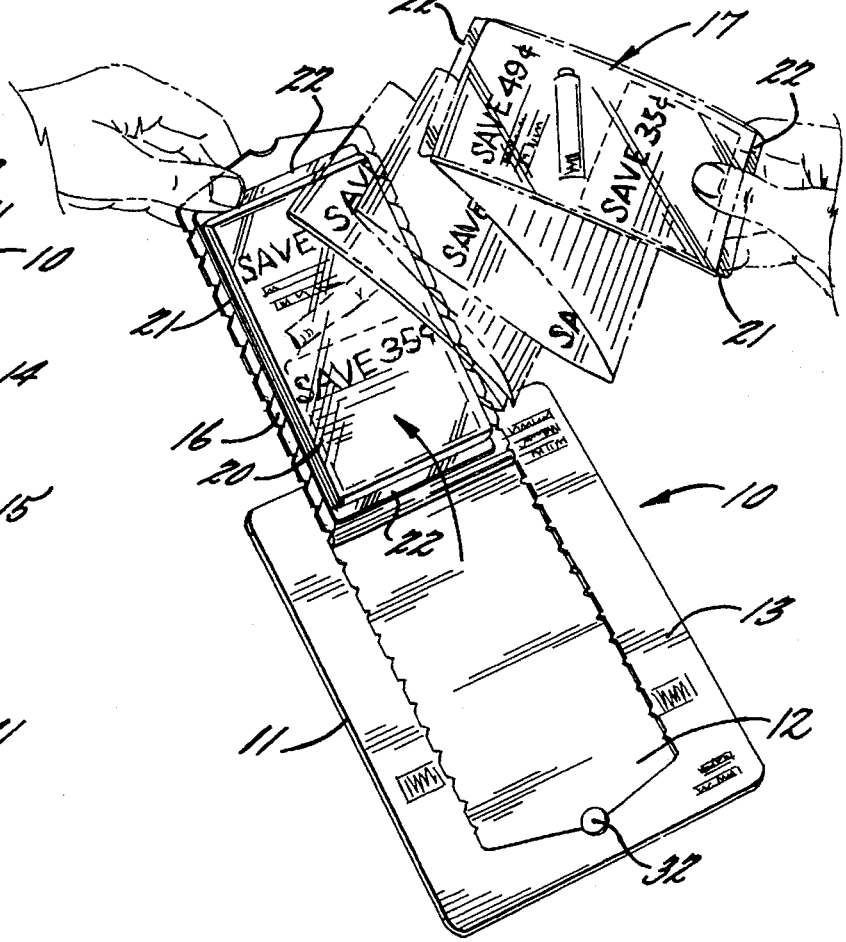
FIG. 4 is a perspective view of the back of the product package according to the present invention showing the removable panel being removed and a booklet of coupons being exposed.

The back layer 13 of the backing member 11 may include a removable panel 16, as shown in FIGS. 2 and 4, for enclosing ancillary materials 17 and securing them from pilferage. The ancillary materials 17 may take several forms, including detailed instructional or regulatory information regarding the use of the product; samples of other products, such as a small packet of fragrance; security devices intended to prevent theft of the product, such as electronic tags which would activate an exit door alarm if the product is passed through the door without having been purchased; or a necessary component of the product itself, such as items which are best left unassembled until after purchase by the consumer.

In one preferred embodiment, the ancillary materials 17 may also include a booklet of coupons 20 for the same or other products which may be fan-folded, as shown in FIG. 2, or edge bound together. In particular, the ancillary materials may be the label for packaged products described in U.S. Pat. No. 5,439,721 to Pedroli, et al., which is incorporated by reference herein. The label may include a booklet 20 and a retention layer 21, made of a clear plastic film such as polyethylene terephthalate, adhered to the top layer of the booklet. The retention layer 21 has releasable adhesive opposite end portions 22 which are used to retain the ancillary materials 17 against the removable panel 16 of the backing member 11, as shown in FIG. 3. Accordingly, after purchase of the product 15, the consumer may tear away the removable panel 16 and remove the retention layer 21 so as to expose the ancillary materials 17, as shown in FIG. 4.

Figure 5:
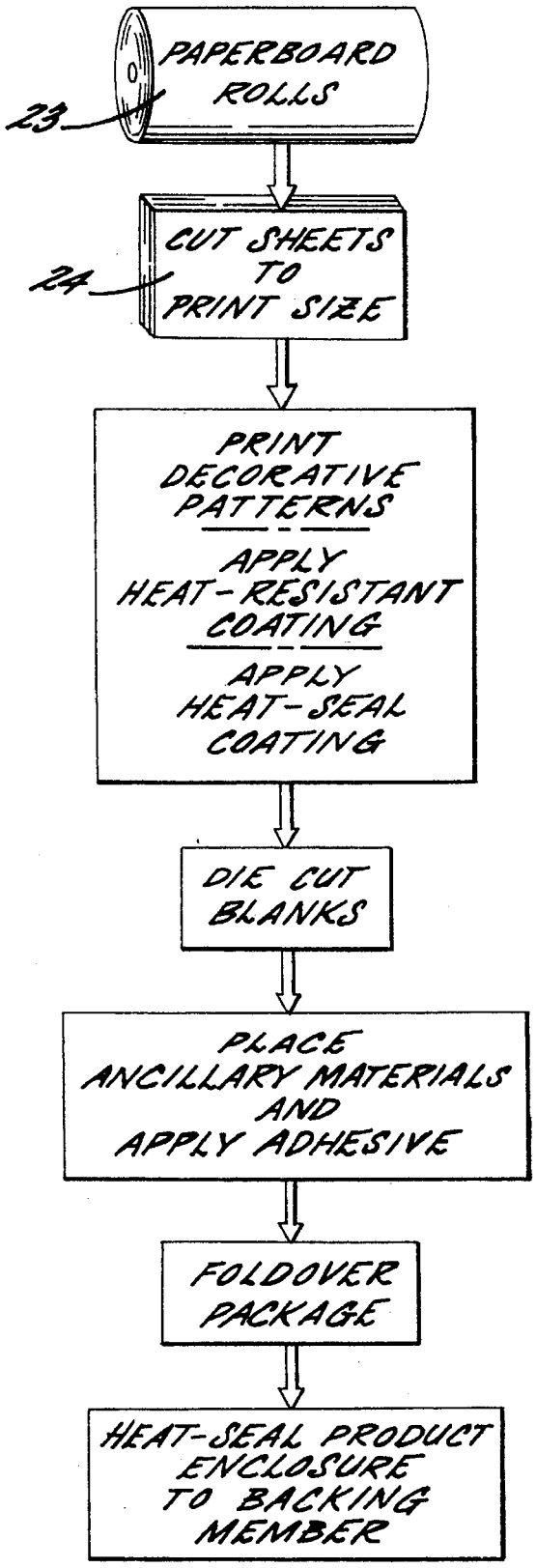
FIG. 5 is a flow chart illustrating the steps taken in the manufacturing process of the present invention.

The process according to the present invention used to manufacture product packages of this type is shown schematically in FIG. 5. Large rolls 23 of backing member material, such as paperboard, are unrolled and cut so as to form a supply of large sheets 24. The sheets 24 are then passed sequentially through a multi-unit printing press capable of sequentially applying layers of colored inks or coatings to one side of each sheet 24.

Figures 6A, 6B, 6C, 6D:
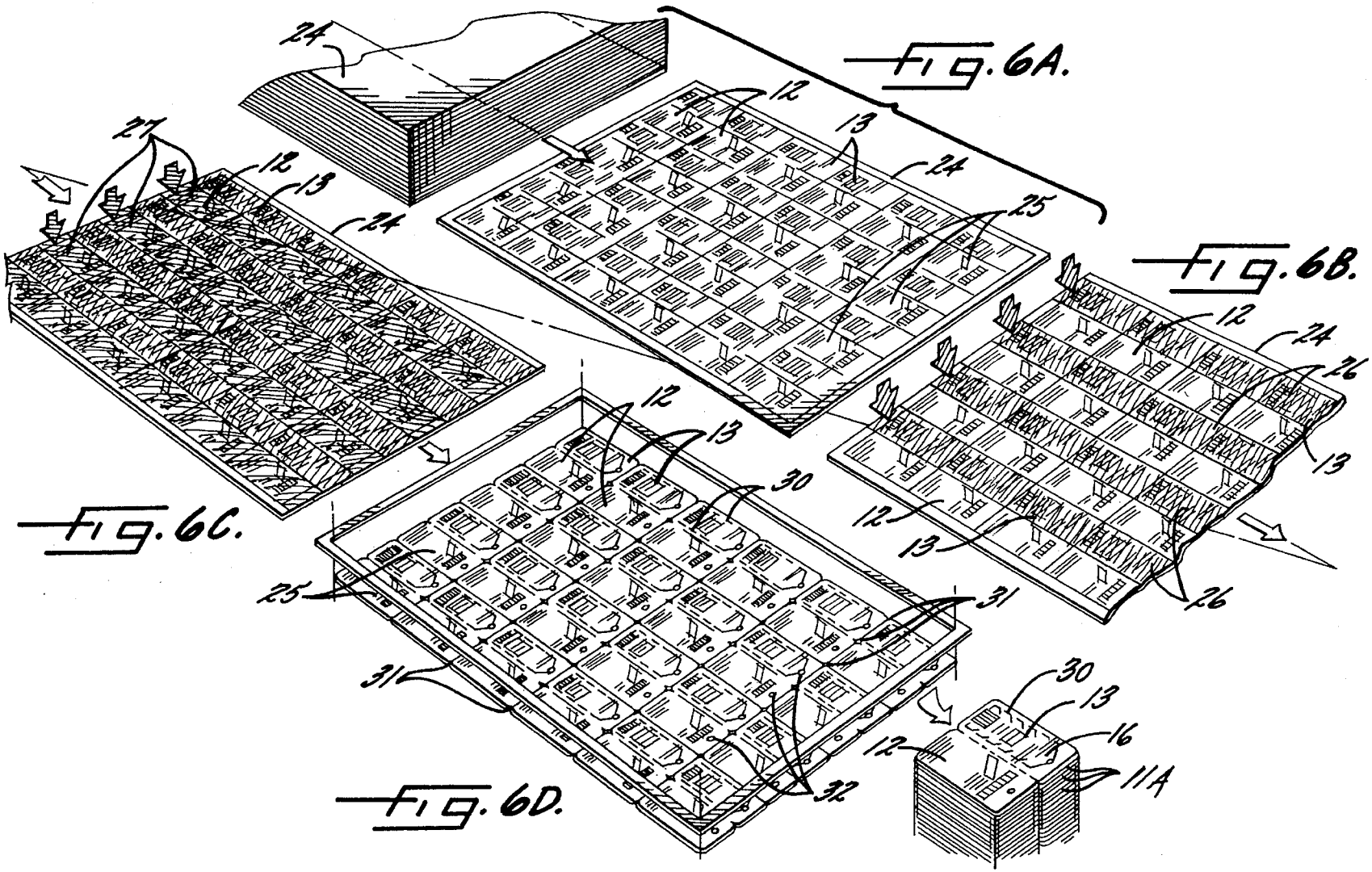
FIGS. 6A–6D are schematic illustrations of the printing, coating application and cutting steps of the present invention.

A plurality of decorative colored patterns 25 is printed on each sheet 24. The patterns 25 may include 4–6 different colors. The patterns 25 are arranged on each sheet in multiple columns and rows so as to define a plurality of backing members 11 laid out in a grid fashion, as shown in FIG. 6A. Each printed backing member 11 includes at least a front layer portion 12 and a back layer portion 13, which when folded together as discussed below, will constitute the respective front and back layers of each backing member. For example, the front layer portion would typically include the product name, and the back layer portion might include a bar code. The colored inks for the decorative patterns 25 may be applied by way of a lithographic printing process, as is conventional in the art.

After all of the colored inks have been applied, but still forming a part of the same continuous process, a heat-resistant coating 26 is applied to the back layer 13 portions of the backing members 11. As shown in FIG. 6B, the heat-resistant coating 26 may be pattern-applied in continuous columns over the back layer portions 13. The heat-resistant coating 26, which prevents the paperboard from scorching when heat is applied, is typically a water based coating which can be applied by way of a lithographic printing process. A preferred heat-resistant coating may be purchased from Pierce-Stevens Company.

As a part of the same continuous operation, the printed sheets 24 are also passed through a coater for applying a heat-seal coating 27 to the front layer portions 12 of the backing members 11. As shown in FIG. 6C, the heat-seal coating 27 may be water based and pattern-applied in continuous columns over the front layer portions 12. A preferred heat-seal coating is also commercially available from Pierce-Stevens Company.

In one preferred embodiment, the heat-seal coater uses a relief printing process to apply the heat-seal coating 27 to the front layer portions 12 of the backing members 11. As is known in the art, a relief printing press may include a roll and a plate wrapped around the roll having a negative image formed by raised portions of the plate which remain after the relief portions have been removed. A particular type of plate which may be used is made of Syril photopolymer, a product of the DuPont Company.

Thus, as shown in FIG. 6C, the printed sheet 24 is coated with alternating columns of heat-resistant coating 26 on the back layer portions 13 and heat-seal coating 27 on the front layer portions 12. The order of application of the heat-resistant and heat-seal coatings 26,27 could be reversed, as would be understood by one of ordinary skill in the art.

Figure 7A:
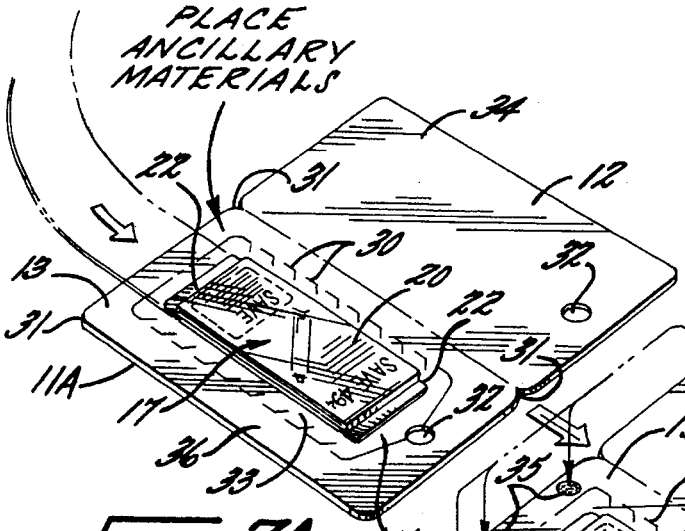
FIGS. 7A–7D show the steps of placing the ancillary materials, applying the adhesive, folding the layers against each other and heat-sealing the product enclosure to the backing member.

After passing through the multi-unit press, the sheets 24 are then passed through a die-cutting press which forms a cut about the periphery of each decorative pattern 25 so as to form a plurality of backing member blanks 11A, and so as to define a folded edge between the layers 12 and 13 of each blank 11A, note FIG. 7A. Various other cuts may also be formed including the plurality of perforations 30 in the back layer portions 13 of each of the blanks 11 which define the removable panel 16. In addition, the corners 31 of each blank may be rounded slightly by an appropriate cut and a hole 32 may be placed at a corresponding place in the front and back layer portions 12,13 so as to define a hole through the entire backing member 11, when folded, for hanging the product package 10 on a display rack. An opening may also be formed in the front layer portion 12 of the backing member blank 11A for receipt of the product enclosure 14, as discussed below. The blanks 11A can then be stacked for further individual processing.

The blanks 11A may then be turned over and the ancillary materials 17 are placed against the unprinted surface of the backing member. As shown in FIG. 7A, the ancillary materials can be placed against the unprinted surface 33 of the removable panel 16, although it would be readily apparent to one of ordinary skill in the art that the ancillary materials 17 could alternatively be applied to the unprinted surface 34 of the front layer portion 12. In cases where the ancillary materials 17 are a booklet of coupons 20 having an adhesive retention layer 21 as discussed above, the booklet may be stripped from a carrier sheet and then pressed against the removable panel 16 to adhere to the booklet thereto.

Figure 7B:
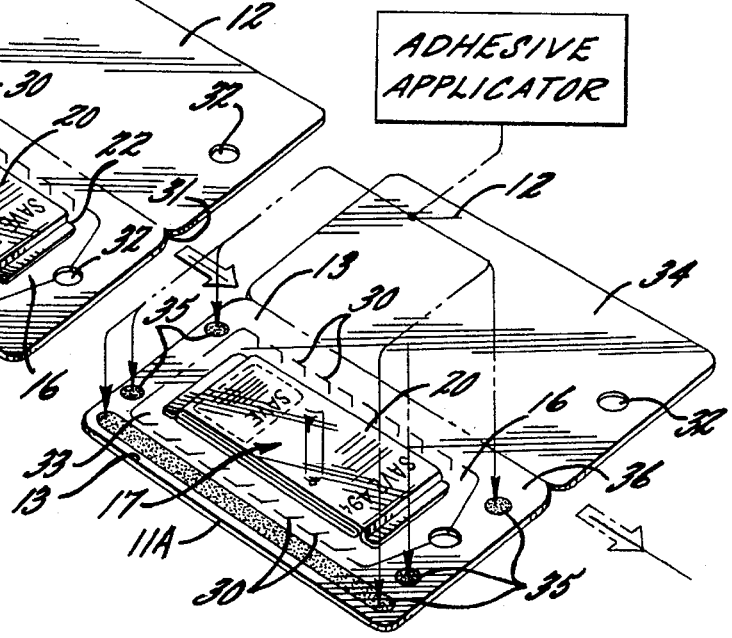
Figure 7C:
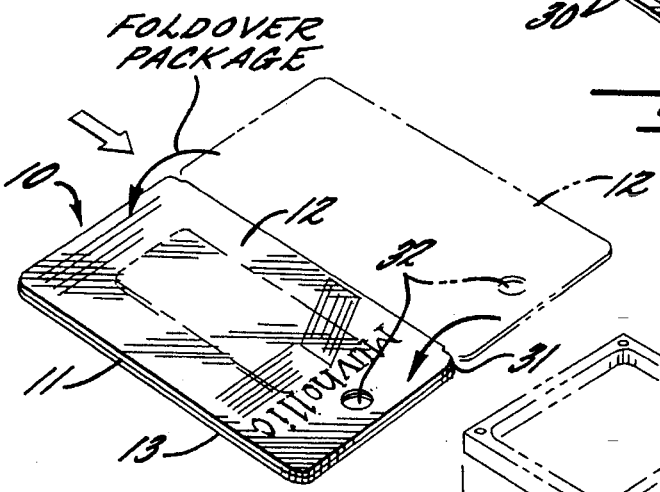

An adhesive 35 suitable for holding the paperboard backing member 11 together is then applied to an unprinted surface of the backing member blank 11A. As shown in FIG. 7B, the adhesive 35 may be applied in a predetermined pattern to the unprinted surface 36 of the back layer portion 13 outside of the periphery of the removable panel 16. The adhesive 35 may be applied manually or by way of injection device or rotating wheel or any other suitable adhesive applicator. Although the adhesive 35 is shown as being applied to the back layer 13 portion of the backing member 11, it would be readily apparent to one of ordinary skill in the art that the adhesive could also, or alternatively, be applied to the unprinted surface 34 of the front layer portion 12. The adhesive 35 may also be applied to any intermediate layers.

The backing member blanks 11A are then folded so that the front and back layers 12,13, and any intermediate layers, are folded against each other. The adhesive 35 bonds the layers together so as to form a multilayer backing member 11 having a heat-seal coating 27 on the front layer 12 thereof and a heat-resistant coating 26 on the back layer 13 thereof.

Figure 7D:
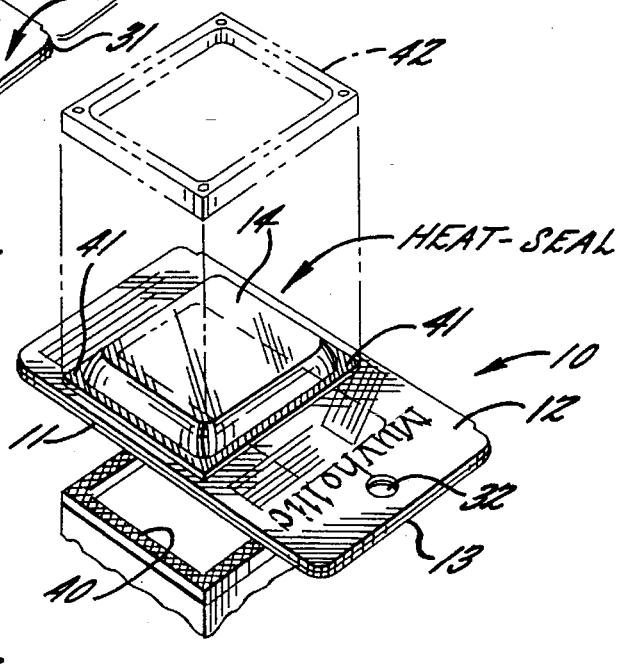

The product 15 and the product enclosure 14, which may have a peripheral flange 41, are then heat-sealed to the backing member 11, as shown in FIG. 7D. The product 15 may be placed in the product enclosure 14 and subsequently heat-sealed to the front layer 12 or the product may be placed on the backing member first and the product enclosure applied thereover. The product enclosure 14 could also be placed through an opening in the front layer 12, as discussed above, so that the flange 41 is trapped between the front 12 and back 13 layers for greater security.

In any event, after the product 15 and enclosure 14 have been placed, a heat-seal head 40 having a form corresponding in size and shape to the flange 41 is then applied to the back layer portion 13 of the backing member 11. A support member 42 having a corresponding size and shape may be pressed against the front layer 12 to counteract the pressing force of the heat-seal head 40.

It may be necessary for the interfacial temperature between the product enclosure flange 41 and the front layer 12 of the backing member 11 to reach 200° degrees Fahrenheit as part of the heat-sealing process. However, because of the insulative properties of the multilayer backing member 11 and the ancillary materials 17, the interfacial temperature between the heat-seal head 40 and the printed back layer 13 may necessarily be much higher. The heat-resistant coating 26, however, prevents the scorching of the back layer.

Many modifications and other embodiments of the invention will come to mind in one of ordinary skill in the art to which this invention pertains having the benefit of the teachings presented in the foregoing descriptions and the associated drawings. For example, it would be readily apparent that one or more intermediate layers could be formed between the front and back layers 12,13 to provide extra stiffness, etc. Therefore, it is to be understood that the invention is not to be limited to the specific embodiments disclosed. Although specific terms are employed, they are used in a generic and descriptive sense only and not for purposes of limitation, and that modifications and embodiments are intended to be included within the scope of the appended claims.

That which is claimed:

1. A process of manufacturing product packages having a multilayer backing member, a plastic product enclosure adhered to a front layer of the backing member, and a removable panel in a back layer of the backing member for enclosing ancillary materials, the process comprising the steps of:

printing on a blank sheet of backing member material a plurality of patterns to be displayed on individual packages thereby defining a plurality of backing members each having a printed surface with at least a front layer portion and a back layer portion, and having a surface opposite thereto;

applying a heat-resistant coating to the back layer portions of the backing members;

applying a heat-seal coating to the front layer portions of the backing members;

cutting the sheet to form a plurality of backing member blanks and to form a pattern of perforations in the back layer portions of each of the blanks, thereby defining the removable panel; and further, with regard to each of the blanks individually;

placing the ancillary materials against the surface opposite the printed surface of one layer of the backing member blank;

applying adhesive to the surface opposite the printed surface of at least one layer of the backing member blank;

folding the front and back layers towards each other thereby forming the multilayer backing member;

placing the product enclosure with the product held therein in contact with the front layer of the backing member; and applying heat to the back layer of the backing member so as to heat-seal the product enclosure to the backing member.

2. A process of manufacturing product packages having a multilayer backing member, a plastic product enclosure adhered to a front layer of the backing member, and a removable panel in a back layer of the backing member for enclosure ancillary materials, the process comprising the steps of:

printing on a blank sheet of backing member material a plurality of patterns to be displayed on individual packages thereby defining a plurality of backing members each having a printed surface with at least a front layer portion and a back layer portion, and having a surface opposite thereto;

applying a heat-resistant coating to the back layer portion of the backing members;

applying a heat-seal coating to the front layer portions of the backing members;

cutting the sheet to form a plurality of backing member blanks and to form a pattern of perforations in the back layer portions of each of the blanks, thereby defining the removable panel; and further, with regard to each of the blanks individually;

placing the ancillary materials against the surface opposite the printed surface of one layer of the backing member blank;

applying adhesive to the surface opposite the printed surface of at least one layer of the backing member blank;

folding the front and back layers towards each other thereby forming the multilayer backing member;

placing the product enclosure with the product held therein in contact with the front layer of the backing member;

applying heat to the back layer of the backing member so as to heat-seal the product enclosure to the backing member; and wherein said cutting step further comprises forming at least one intermediate layer portion for each of said blanks and said folding step further comprises folding the at least one intermediate layer between the front layer and the back layer.

3. A process of manufacturing product packages having a multilayer backing member, a plastic product enclosure adhered to a front layer of the backing member, and a removable panel in a back layer of the backing member for enclosing ancillary materials, the process comprising the steps of:

printing on a blank sheet of backing member material a plurality of patterns to be displayed on individual packages thereby defining a plurality of backing members each having a printed surface with at least a front layer portion and a back layer portion, and having a surface opposite thereto;

applying a heat-resistant coating to the back layer portions of the backing members;

applying a heat-seal coating to the front layer portions of the backing members;

cutting the sheet to form a plurality of backing member blanks and to form a pattern of perforations in the back layer portions of each of the blanks, thereby defining the removable panel; and further, with regard to each of the blanks individually;

placing the ancillary materials against the surface opposite the printed surface to one layer of the backing member blank;

applying adhesive to the surface opposite the printed surface of at least one layer of the backing member blank;

folding the front and back layers towards each other thereby forming the multilayer backing member;

placing the product enclosure with the product held therein in contact with the front layer of the backing member;

applying heat to the back layer of the backing member so as to heat-seal the product enclosure to the backing member; and cutting an opening in the front layer portion of the blank corresponding in shape and size to the product enclosure, and wherein said product enclosure placement step further comprises placing the product enclosure through the opening prior to said folding step such that part of the product enclosure is engaged between the front and back layers when folded.

4. A process as defined in claim 1 comprising the further step of adhering the ancillary materials to the surface opposite the printed surface of the removable panel.

5. A process as defined in claim 1 wherein said printing, heat-resistant coating application and heat-seal coating application steps occur in one pass through a multi-unit printing press.

6. A process as defined in claim 1 wherein said printing step and said heat-resistant coating application step comprise lithographic printing.

7. A process as defined in claim 1 wherein said heat-seal coating application step comprises applying a water based heat-seal coating by relief printing.

8. A process of manufacturing product packages having a multilayer backing member, a plastic product enclosure adhered to a front layer of the backing member, and a removable panel in a back layer of the backing member for enclosing ancillary materials, the process comprising the steps of:

printing on a blank sheet of backing member material by lithographic printing a plurality of patterns to be displayed on individual packages thereby defining a plurality of backing members each having a printed surface with at least a front layer portion and a back layer portion, and having a surface opposite thereto;

applying a heat-resistant coating by lithographic printing to the back layer portions only of the backing members;

applying a heat-seal coating by relief printing to the front layer portions only of the backing members;

cutting the sheet to form a plurality of backing member blanks and to form a pattern of preforations in the back layer portions of each of the blanks, thereby defining the removable panel; and further, with regard to each of the blanks individually;

placing the ancillary materials against the surface opposite the printed surface of one layer of the backing member blank;

applying adhesive to the surface opposite the printed surface of at least one layer of the blank;

folding the front and back layers towards each other thereby forming the multilayer backing member;

placing the product enclosure with the product held therein in contact with the front layer of the backing member; and applying heat to the back layer of the backing member so as to heat-seal the product enclosure to the backing member.

9. A process of manufacturing product packages having a multilayer backing member, a plastic product enclosure adhered to a front layer of the backing member, and a removable panel in a back layer of the backing member for enclosing ancillary materials, the process comprising the steps of:

printing on a blank sheet of backing member material by lithographic printing a plurality of patterns to be displayed on individual packages thereby defining a plurality of backing members each having a printed surface with at least a front layer portion and a back layer portion, and having a surface opposite thereto;

applying a heat-resistant coating by lithographic printing to the back layer portions only of the backing members;

applying a heat-seal coating by relief printing to the front layer portions only of the backing members;

cutting the sheet to form a plurality of backing member blanks and to form a pattern of perforations in the back layer portions of each of the blanks, thereby defining the removable panel; and further, with regard to each of the blanks individually;

placing the ancillary materials against the surface opposite the printed surface of one layer of the backing member blank;

applying adhesive to the surface opposite the printed surface of at least one layer of the blank;

folding the front and back layers towards each other thereby forming the multilayer backing member;

placing the product enclosure with the product held therein in contact with the front layer of the backing member;

applying heat to the back layer of the backing member so as to heat-seal the product enclosure to the backing member; and wherein said cutting step further comprises forming at least one intermediate layer portion for each of said blanks and said folding step further comprises folding the at least one intermediate layer between the front layer and the back layer.

10. A process of manufacturing product packages having a multilayer backing member, a plastic product enclosure adhered to a front layer of the backing member, and a removable panel in a back layer of the backing member for enclosing ancillary materials, the process comprising the steps of:

printing on a blank sheet of backing member material by lithographic printing a plurality of patterns to be displayed on individual packages thereby defining a plurality of backing members each having a printed surface with at least a front layer portion and a back layer portion, and having a surface opposite thereto;

applying a heat-resistant coating by lithographic printing to the back layer portions only of the backing members;

applying a heat-seal coating by relief printing to the front layer portions only of the backing members;

cutting the sheet to form a plurality of backing member blanks and to form a pattern of perforations in the back layer portions of each of the blanks, thereby defining the removable panel; and further, with regard to each of the blanks individually;

placing the ancillary materials against the surface opposite the printed surface of one layer of the backing member blank;

applying adhesive to the surface opposite the printed surface of at least one layer of the blank;

folding the front and back layers towards each other thereby forming the multilayer backing member;

placing the product enclosure with the product hold therein in contact with the front layer of the backing member;

applying heat to the back layer of the backing member so as to heat-seal the product enclosure to the backing member; and cutting an opening in the front layer portion of the blank corresponding in shape and size to the product enclosure, and wherein said product enclosure placement step further comprises placing the product enclosure through the opening prior to said folding step such that part of the product enclosure is engaged between the front and back layers when folded.

11. A process as defined in claim 8 comprising the further step of releasably adhering the ancillary materials to the surface opposite the printed surface of the removable panel.

12. A process as defined in claim 8 wherein said printing, heat-resistant coating application and heat-seal coating application steps occur in one pass through a multi-unit printing press.

13. A process of manufacturing product packages having a multilayer backing member and a plastic product enclosure adhered to a front layer of the backing member, the process comprising the steps of:

printing on a blank sheet of backing member material a plurality of patterns to be displayed on individual packages thereby defining a plurality of backing members each having a printed surface with at least a front layer portion and a back layer portion, and having a surface opposite thereto;

applying a heat-resistant coating to the back layer portions of the backing members;

applying a heat-seal coating to the front layer portions of the backing members;

cutting the sheet to form a plurality of backing member blanks; and further, with regard to each of the blanks individually;

applying adhesive to the surface opposite the printed surface of at least one layer of the blank;

folding the front and back layers towards each other thereby forming the multilayer backing member, placing the product enclosure with the product held therein in contact with the front layer of the backing member; and applying heat to the back layer of the backing member so as to heat-seal the product enclosure to the backing member.

14. A process of manufacturing a multilayer backing member for a product package having a front layer to which a plastic product enclosure may be heat-sealed, and a removable panel in a back layer of the backing member for enclosing ancillary materials, the process comprising the steps of:

printing on a blank sheet of backing member material a plurality of patterns to be displayed on individual backing members thereby defining a plurality of backing members each having a printed surface with at least a front layer portion and a back layer portion, and having an unprinted surface opposite thereto, and with the front layer portions and the back layer portions being disposed in parallel columns respectively on the blank sheet;

applying a heat-resistant coating to each of the columns of the back layer portions of the backing members;

applying a heat-seal coating to each of the columns of the front layer portions of the backing members;

cutting the sheet to form a plurality of backing member blanks, each including a front layer portion and a back layer portion which are interconnected along at least one fold line, with the cutting step also including forming a pattern of perforations in the back layer portion of each of the blanks, thereby defining the removable panel; and further, with regard to each of the blanks individually;

placing the ancillary materials against the surface opposite the printed surface of one of the front and back layer portions of the backing member blank;

applying adhesive to the surface opposite the printed surface of at least one of the front and back layer portions of the backing member blank; and, folding the front and back layer portions against each other along said one fold line so as to fold the adhesive between the front and back layer portions and thereby enclose the ancillary materials and form the multilayer backing member.

15. A process of manufacturing a multilayer backing member for a product package having a front layer to which a plastic product enclosure may be heat-sealed, and a removable panel in a back layer of the backing member for enclosing ancillary materials, the process comprising the steps of:

printing on a blank sheet of backing member material a plurality of patterns to be displayed on individual backing members thereby defining a plurality of backing members each having a printed surface with at least a front layer portion and a back layer portion, and having an unprinted surface opposite thereto, and with the front layer portions and the back layer portions being disposed in parallel columns respectively on the blank sheet;

applying a heat-resistant coating to each of the columns of the back layer portions of the backing members;

applying a heat-seal coating to each of the columns of the front layer portions of the backing members;

cutting the sheet of form a plurality of backing member blanks, each including a front layer portion and a back layer portion which are interconnected along at least one fold line, with the cutting step also including forming a pattern of perforations in the back layer portion of each of the blanks, thereby defining the removable panel; and further, with regard to each of the blanks individually;

placing the ancillary materials against the surface opposite the printed surface of one of the front and back layer portions of the backing member blank;

applying adhesive to the surface opposite the printed surface of at least one of the front and back layer portions of the backing member blank;

folding the front and back layer portions against each other along said one fold line so as to fold the adhesive between the front and back layer portions and thereby enclose the ancillary materials and form the multilayer backing member; and wherein said cutting step further comprises forming at least one intermediate layer portions for each of said blanks and said folding step further comprises folding the at least one intermediate layer between the front layer and the back layer.

16. A process as defined in claim 14 comprising the further step of adhering the ancillary materials to the surface opposite the printed surface of the removable panel.

17. A process as defined in claim 14 wherein said printing, heat-resistant coating application and heat-seal coating application steps occur in one pass through a multi-unit printing press.

18. A process as defined in claim 14 wherein said printing step and said heat-resistant coating application step comprise lithographic printing.

19. A process as defined in claim 14 wherein said heat-seal coating application step comprises applying a water based heat-seal coating by relief printing.

20. A process as defined in claim 14 comprising the further subsequent steps of:

placing a product so as to overlie the front layer portion;

placing a clear plastic enclosure so as to overlie the product and so that the periphery of the plastic enclosure contacts the front layer portion; and applying heat to the back layer portion of the backing member so that the heat passes through the backing member and activates the heat-seal coating to thereby heat-seal the product enclosure to the backing member.

* * * * *